US006383632B2

(12) United States Patent
Howell et al.

(10) Patent No.: US 6,383,632 B2
(45) **Date of Patent: *May 7, 2002**

(54) FINE DENIER YARN FROM POLY (TRIMETHYLENE TEREPHTHALATE)

(75) Inventors: James M. Howell; Joe Forrest London, Jr., both of Greenville, NC (US); Michelle H. Watkins, Waynesboro, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/795,518

(22) Filed: Feb. 28, 2001

Related U.S. Application Data

(63) Continuation-in-part of application No. 09/518,759, filed on Mar. 3, 2000, now abandoned.

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS

| | | | | |
|---|---|---|---|---|
| 3,350,871 | A | 11/1967 | Pierce et al. | 57/140 |
| 3,584,103 | A | 6/1971 | Harris | 264/168 |
| 3,681,188 | A | 8/1972 | Harris | 161/173 |
| 3,816,486 | A | 6/1974 | Vail | 260/75 R |
| 3,984,600 | A | 10/1976 | Kawase et al. | 428/364 |
| 4,475,330 | A | 10/1984 | Kimura et al. | 57/245 |
| 5,250,245 | A | 10/1993 | Collins et al. | 264/103 |
| 5,340,909 | A | 8/1994 | Doerr et al. | 528/276 |
| 5,645,782 | A | 7/1997 | Howell et al. | 264/103 |
| 5,662,980 | A | 9/1997 | Howell et al. | 428/88 |
| 5,782,935 | A | 7/1998 | Hirt et al. | 8/512 |
| 5,885,909 | A | 3/1999 | Rudisill et al. | 442/82 |
| 6,023,926 | A | 2/2000 | Flynn | 57/210 |
| 6,033,777 | A | 3/2000 | Best | 428/364 |
| 6,071,612 | A | 6/2000 | Roderiquez et al. | 428/364 |
| 6,245,844 | B1 | 6/2001 | Kurian et al. | |
| 6,255,442 | B1 | 7/2001 | Kurian et al. | |
| 6,284,370 | B1 | 9/2001 | Fujimoto | |
| 6,287,688 | B1 * | 9/2001 | Howel et al. | 428/364 |
| 2001/0003618 | A1 | 6/2001 | Kato et al. | |

FOREIGN PATENT DOCUMENTS

| | | |
|---|---|---|
| EP | 0 049 412 | 4/1985 |
| EP | 0 745 711 A1 | 12/1996 |
| EP | 1 016 741 A1 | 7/2000 |

(List continued on next page.)

OTHER PUBLICATIONS

International Search Report from counterpart PCT application No. PCT/US01/06567.
H. L. Traub, "Synthese und textilchemische Eigenschaften des Poly–Trimethyleneterephthalats", *Dissertaion Universitat Stuttgart*, (1994) (English Translation).
Katsuhiko et al., "Elastic Moduli of Poly(trimethylene terephthalate) in the Crystalline Region", *Zairyo* (*Material*), 35, No. 396, 106–110, (1986).
W. Oppermann et al., Fibers Made of Poly(trimethylene terephthalate), Dornbirn, (1995).
H. L. Traub et al., "Mechanical Properties of Fibers Make of Polytrimethylene Terephthalate", *Chemical Fibers International* (*CFI*), 45, 110–111, (1995).
H. L. Traub, Dyeing Properties of Poly(Trimethylene Terephthalate) Fibres, *Melliand*, (1995).
Degussa Trade Literature (Estimated 1994).

*Primary Examiner*—Newton Edwards
(74) *Attorney, Agent, or Firm*—Mark D. Kuller

(57) ABSTRACT

Fine denier poly(trimethylene terephthalate) feed yarns and drawn yarns wherein the drawn yarns are characterized by a denier per filament less than 1.5 and are drawn such that the actual draw ratio is within 10 percent of the predicted draw ratio determined according to: [(elongation to break of the feed yarn)+115]/[(elongation to break of the drawn yarn)+115)] are disclosed.

20 Claims, 1 Drawing Sheet

FOREIGN PATENT DOCUMENTS

| | | | | |
|---|---|---|---|---|
| EP | 1 033 422 | A1 | 9/2000 | |
| EP | 1 052 325 | A1 | 11/2000 | |
| GB | 1075689 | | 7/1967 | |
| GB | 1165312 | | 9/1969 | |
| GB | 1254826 | | 11/1971 | |
| GB | 1408094 | | 10/1975 | |
| JP | 5-71013 | | 3/1993 | |
| JP | 11-12824 | | 1/1999 | |
| JP | 11-93026 | | 4/1999 | |
| JP | 11-93031 | | 4/1999 | |
| JP | 11-93049 | | 4/1999 | |
| JP | 11-107036 | | 4/1999 | |
| JP | 11-107038 | | 4/1999 | |
| JP | 11-107081 | | 4/1999 | |
| JP | 11-107154 | | 4/1999 | |
| JP | 11-172526 | | 6/1999 | |
| JP | 99158747 | A | 6/1999 | ..... D03D/15/00 |
| JP | 11-181626 | | 7/1999 | |
| JP | 11-181650 | | 7/1999 | |
| JP | 11-189920 | | 7/1999 | |
| JP | 11-200143 | | 7/1999 | |
| JP | 11-200175 | | 7/1999 | |
| JP | 11-229276 | | 8/1999 | |
| JP | 11-100721 | | 4/2000 | |
| JP | 00248439 | A | 9/2000 | ..... D02G/3/32 |
| WO | 98/23662 | | 6/1998 | |
| WO | 98/27168 | | 6/1998 | |
| WO | 99/39041 | | 1/1999 | |
| WO | 99-11709 | | 3/1999 | |
| WO | 99-11845 | | 3/1999 | |
| WO | 00/22210 | | 4/2000 | |
| WO | 00/29653 | | 5/2000 | |
| WO | 2000-26301 | | 5/2000 | |

* cited by examiner

FINE DENIER YARN FROM POLY (TRIMETHYLENE TEREPHTHALATE)

PRIORITY

This is a continuation-in-part of U.S. patent application Ser. No. 09/518,759, filed Mar. 3, 2000, now abandoned, which is incorporated herein by reference.

FIELD OF THE INVENTION

The present invention relates to very fine denier polyester yarn made from poly(trimethylene terephthalate) fibers.

BACKGROUND OF THE INVENTION

Polyester yarns having very fine denier are highly desirable for manufacturing fabrics used in the garment industry. Such yarns are desirable because they yield a light-weight material having excellent properties such as softness. The softness of a yarn and fabric is a measure of how soft a material feels to the touch. A yarn and fabric used for many clothing apparel items require a high degree of softness.

Very fine denier polyester fibers currently known in the art are made using polyethylene terephthalate. Such yarns provide softness suitable for many garments such as, e.g., dresses, jackets and other ladies' apparel. However, because polyethylene terephthalate has a high Young's modulus, the maximum softness achieved is not suitable for garments requiring ultra-soft touch.

There is therefore a need in the art for very fine denier polyester yarns having superior softness quality. Theoretically, polyester yarns made from a polymer having a low Young's modulus should yield the desirable properties. However, attempts to commercially manufacture such a fine denier polyester yarn from poly(trimethylene terephthalate) have not been successful due to various manufacturing problems. For example, when attempting to make very fine denier yarns from poly(trimethylene terephthalate), excessive breaks in the fibers have been experienced. Further, it was thought in the prior art that the tenacity of poly(trimethylene terephthalate) was too low to successfully make a very fine denier yarn.

SUMMARY OF THE INVENTION

The present invention comprises a drawn yarn made from a partially oriented feed yarn, said feed yarn made from a polyester polymer melt-extruded at a spinning temperature between about 255° C. and 275° C., wherein said polymer comprises at least 85 mole % poly(trimethylene terephthalate) wherein at least 85 mole % of repeating units consist of trimethylene units, and wherein said polymer has an intrinsic viscosity of at least 0.80 dl/g, and wherein said drawn yarn has the following characteristics:

(a) a denier per filament less than about 1.5; and (b) an actual draw ratio within 10 percent of a predicted draw ratio, wherein the predicted draw ratio is determined according to: [(elongation to break of the feed yarn)+115]/[(elongation to break of the drawn yarn)+115)].

The present invention further comprises a process for making a drawn yarn from a partially oriented feed yarn, comprising the steps:

(a) extruding a molten polyester polymer at a temperature between about 255° C. and about 275° C. through a spinneret to form filaments, wherein said polymer comprises at least 85 mole % poly(trimethylene terephthalate) wherein at least 85 mole % of repeating units consist of trimethylene units, and wherein said polymer has an intrinsic viscosity of at least 0.80 dl/g;

(b) cooling the filaments by exposing them to a flow of quench air;

(c) coating the filaments with a spin finish;

(d) heating the filaments to a temperature greater than the glass transition temperature of the filaments, but less than 200° C., prior to drawing the filaments; and (e) drawing the filaments between a set of feed rolls to produce a denier per filament less than about 1.5 and an actual draw ratio within 10 percent of a predicted draw ratio, wherein the predicted draw ratio is determined according to: [(elongation to break of the feed yarn)+115]/[(elongation to break of the drawn yarn)+115)].

The present inventions further comprises a fine denier feed yarn made from a polyester polymer melt-extruded at a spinning temperature between about 255° C. and about 275° C., wherein said polymer comprises at least 85 mole % poly(trimethylene terephthalate) wherein at least 85 mole % of repeating units consist of trimethylene units, and wherein said polymer has an intrinsic viscosity of at least 0.80 dl/g, and wherein said fine denier feed yarn has a denier per filament less than about 2.

DETAILED DESCRIPTION OF THE INVENTION

Figure 1:
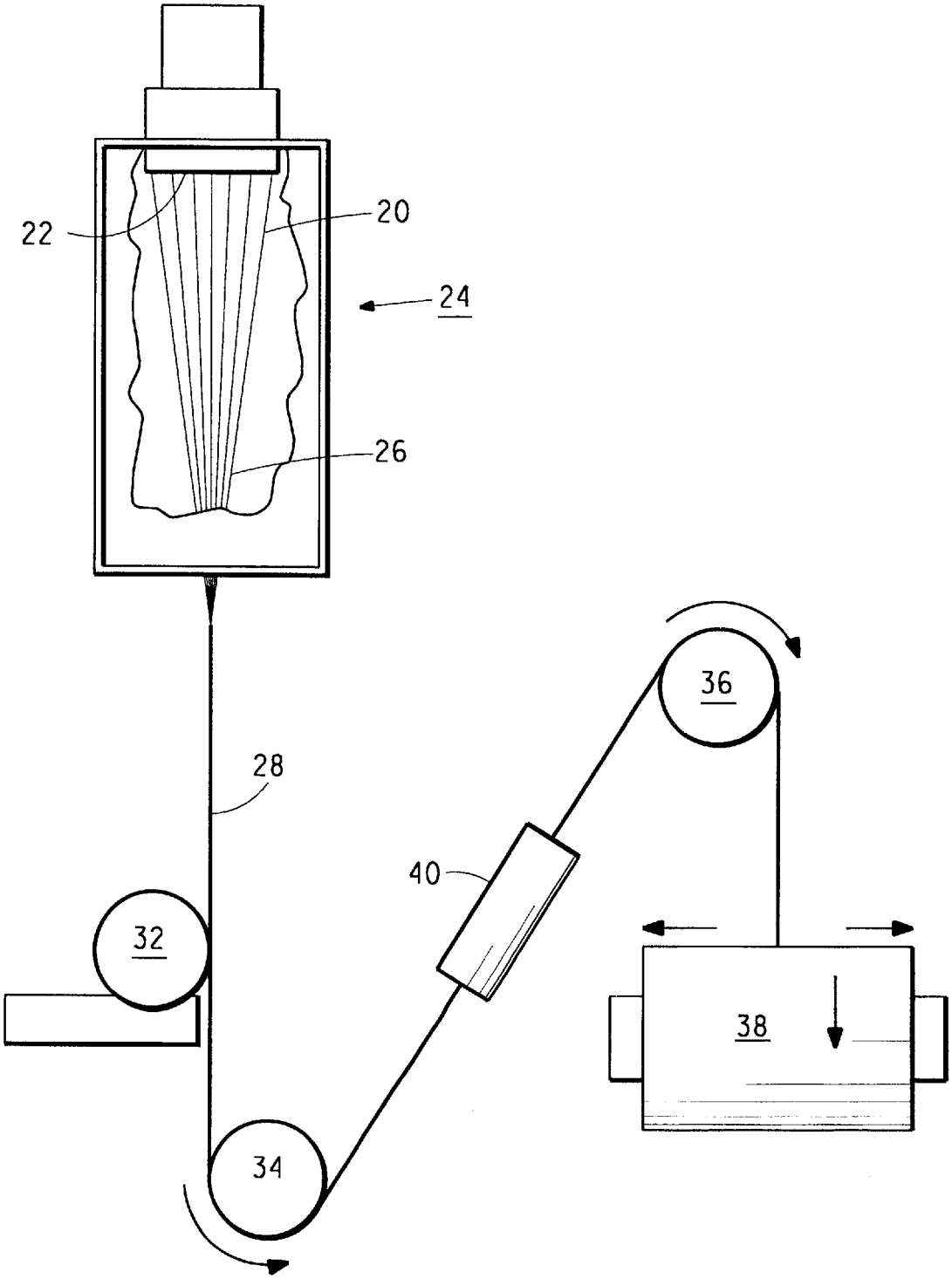
FIG. 1 is a schematic diagram of an exemplary spinning position for making the very fine denier poly(trimethylene terephthalate) yarns of the present invention.

The present invention provides a very fine denier polyester drawn yarn made from poly(trimethylene terephthalate) and a feed yarn and process for making the same. The very fine denier feed yarn of the present invention is a multifilament yarn wherein the denier per filament is less than about 2 dpf (2.22 dtex/filament). Preferably, the denier per filament of the feed yarn is less than 1.5 dpf (1.67 dtex/filament) and, most preferably, the denier per filament is less than 1 dpf (1.11 dtex/filament). The very fine denier drawn yarn of the present invention is a multifilament yarn wherein the denier per filament is less than about 1.5 dpf (1.67 dtex/filament). Preferably, the denier per filament is less than 1 dpf (1.11 dtex/filament). The feed yarns (and consequently, the drawn yarns) are made from a polyester polymer, wherein said polymer comprises at least 85 mole % poly(trimethylene terephthalate) wherein at least 85 mole % of repeating units consist of trimethylene units, and wherein said polymer has an intrinsic viscosity of at least 0.80 dl/g. Preferably, the intrinsic viscosity is at least 0.90 dl/g and, most preferably, it is at least 1.00 dl/g. Partially oriented feed yarn is made using conventional melt-spinning techniques, at a spinning temperature of about 255° C. to about 275° C. Molten polymer is extruded through spinneret orifices of diameter from about 0.12 mm to about 0.38 mm. The yarns of the present invention are drawn such that actual draw ratio is within ten percent of the predicted draw ratio. This requirement is satisfied if the draw ratio difference, ΔDR, is less than ten percent. The draw ratio difference, ΔDR, as defined herein is defined according to equation (I):

$$\Delta DR = \left| \frac{DR_P - DR_A}{DR_A} \right| \leq 10\%, \quad \text{(I)}$$

where $DR_A$ is the actual draw ratio, and $DR_P$ is the predicted draw ratio. The predicted draw ratio, $DR_P$ is defined according to equation (II):

$$DR_P = \frac{E_B(F_Y) + 115}{E_B(D_Y) + 115}, \quad \text{(II)}$$

where, $E_B(F_Y)$ is the elongation to break of the partially oriented feed yarn and $E_B(D_Y)$ is the elongation to break of the drawn yarn. Preferably, the actual draw ratio is within five percent of the predicted draw ratio and, most preferably, it is within three percent.

As shown in FIG. 1, molten streams 20 of poly (trimethylene terephthalate) polymer are extruded through orifices in spinneret 22 downwardly into quench zone 24 supplied with radially or transversely directed quenching air. The diameter and quantity of orifices in spinneret 22 may be varied depending upon the desired filament size and the number of filaments in the multifilament yarn of the present invention. Further, the temperature of molten streams 20 is controlled by the spin block temperature, which is also known as the spinning temperature. It has been found that an orifice diameter of about 0.12 mm to about 0.38 mm can be used to produce the very fine filament yarns of the present invention. Further, a spinning temperature between about 255° C. and 275° C. is required to make the very fine denier yarns of the present invention. Preferably, the spinning temperature is between about 260° C. and 270° C. and, most preferably, the spinning temperature is maintained at 265° C.

Streams 20 solidify into filaments 26 at some distance below the spinneret within the quench zone. Filaments 26 are converged to form multifilament yarn 28. A conventional spin-finish is applied to yarn 28 through a metered application or by a roll application such as finish roll 32. Yarn 28 next passes in partial wraps about godets 34 and 36 and is wound on package 38. The filaments may be interlaced if desired, as by pneumatic tangle chamber 40.

The partially oriented poly(trimethylene terephthalate) yarns are then drawn using conventional drawing equipment, such as a Barmag DW48. According to the present invention, the yarns are drawn such that the draw ratio difference, ΔDR, is less than ten percent, as described above.

The very fine filament yarns of the present invention are suitable for warp drawing, air jet texturing, false-twist texturing, gear crimping, and stuffer-box crimping, for example, The yarns of the present invention may be used to make any fabrics which could be made from very fine denier polyethylene terephthalate yarns, such as disclosed in U.S. Pat. No. 5,250,245, which is incorporated herein by reference in its entirety. Tows made from these filament may also be crimped, if desired, and cut into staple and flock. The fabrics made from these improved yarns may be surface treated by conventional sanding and brushing to give suede-like tactility. The filament surface frictional characteristics may be changed by selection of cross-section, delusterant, and through such treatments as alkali-etching. The improved combination of filament strength and uniformity makes these filaments especially suited for end-use processes that require fine filament yarns without broken filaments (and yarn breakage) and uniform dyeing with critical dyes.

The fine filament yarns of the present invention are especially suitable for making high-end density moisture-barrier fabrics, such as rainwear and medical garments. The surface of the knit and woven fabrics can be napped (brushed or sanded). To reduce the denier even further, the filaments may be treated (preferably in fabric form) with conventional alkali procedures. The fine filament yarns of the present invention may be co-mingled on-line in spinning or off-line with higher denier polyester (or nylon) filaments to provide for cross-dyed effects and/or mixed shrinkage post-bulkable potential, where the bulk may be developed off-line, such as over feeding in the presence of heat while beaming/slashing or in fabric form, such as in the dye bath. The degree of interlace is selected based on the textile processing needs and final desired yarn/fabric aesthetics. Because of the low Young's modulus of poly(trimethylene terephthalate), the very fine denier yarns of the present invention are especially suitable for fabrics where softness is important.

Measurements discussed herein were made using conventional U.S. textile units, including denier, which is a metric unit. The dtex equivalents for denier are provided in parentheses after the actual measured values. Similarly, tenacity and modulus measurements were measured and reported in grams per denier ("gpd") with the equivalent dN/tex value in parentheses.

TEST METHODS

The physical properties of the partially oriented poly (trimethylene terephthalate) yarns reported in the following examples were measured using an Instron Corp. tensile tester, model no. 1122. More specifically, elongation to break, $E_B$, and tenacity were measured according to ASTM D-2256.

Boil off shrinkage ("BOS") was determined according to ASTM D 2259 as follows: a weight was suspended from a length of yarn to produce a 0.2 g/d (0.18 dN/tex) load on the yarn and measuring its length, $L_1$. The weight was then removed and the yarn was immersed in boiling water for 30 minutes. The yarn was then removed from the boiling water, centrifuged for about a minute and allowed to cool for about 5 minutes. The cooled yarn is then loaded with the same weight as before. The new length of the yarn, $L_2$, was recorded. The percent shrinkage was then calculated according to equation (III), below:

$$\text{Shrinkage (\%)} = \frac{L_1 - L_2}{L_1} \times 100 \quad \text{(III)}$$

Dry heat shrinkage ("DHS") was determined according to ASTM D 2259 substantially as described above for BOS. $L_1$ was measured as described, however, instead of being immersed in boiling water, the yarn was placed in an oven at about 160° C. After about 30 minutes, the yarn was removed from the oven and allowed to cool for about 15 minutes before $L_2$ was measured. The percent shrinkage was then calculated according to equation (III), above.

Intrinsic viscosity was measured in 50/50 weight percent methylene chloride/triflouroacetic acid following ASTM D 4603-96.

EXAMPLE I

Polymer Preparation

Polymer Preparation 1

Poly(trimethylene terephthalate) polymer was prepared using batch processing from dimethylterephthalate and 1,3-propanediol. A 40 lb (18 kg) horizontal autoclave with an agitator, vacuum jets and a monomer distillation still located above the clave portion of the autoclave was used. The monomer still was charged with 40 lb (18 kg) of dimethyl terephthalate and 33 lb (15 kg) of 1,3-propanediol. Sufficient lanthanum acetate catalyst was added to obtain 250 parts per million ("ppm") lanthanum in the polymer. Parts per million is used herein to mean micrograms per gram. In addition, tetraisopropyl titanate polymerization catalyst was added to the monomer to obtain 30 ppm titanium in the polymer. The temperature of the still was gradually raised to 245° C. and approximately 13.5 lb (6.2 kg) of methanol distillate were recovered.

An amount of phosphoric acid in 1,3-propanediol solution to obtain about 160 ppm phosphorous in the polymer was added to the clave. If delustered polymer was desired, then a 20 percent by weight ("wt. %") slurry of titanium dioxide ($TiO_2$) in 1,3-propanediol solution was added to the clave in an amount to give 0.3 wt. % in polymer. The ingredients were agitated and well mixed and polymerized by increasing the temperature to 245° C., reducing pressure to less than 3 millimeters of mercury (less than 400 Pa) and agitating for a period of four to eight hours. With polymer molecular weight at the desired level, polymer was extruded through a ribbon or strand die, quenched, and cut into a flake or pellet size suitable for melt extrusion or solid state polymerizing. Polymer intrinsic viscosity ("IV") in the range of 0.60 dl/g to 1.00 dl/g was produced by this method.

The polymer made by this process (with TiO2) was used in Example II-3. The polymers used in Examples II-5, II-6, II-7, II-8, II-9, III-13 and III-14 were made in substantially the same manner, except that $TiO_2$ was not added, and had the same IV. The polymers for Examples II-10 and III-15 were made in the same way, but had a slightly higher IV and did contain $TiO_2$.

Polymer Preparation 2

Higher molecular weight polymer (IV>1.00 dl/g) for Examples II-2, III-11 and III-12 was produced by solid state polymerizing polymer chip or flake (made in the same way as described above) in a fluidized bed polymerizer. The polymer of Example III-11 included $TiO_2$, whereas the others did not. Crystallized and dried polymer was charged to a fluidized bed reactor continually agitated and purged with dry, inert gas and maintained at a temperature of 200° C. to 220° C. for up to 10 hours to produce polymer with IV up to 1.40.

Polymer Preparation 3

Poly(trimethylene terephthalate) polymer for use in Example II-4 was prepared from terephthalic acid and 1,3-propanediol using a two vessel process utilizing an esterification vessel ("reactor") and a polycondensation vessel ("clave"), both of jacketed, agitated, deep pool design. 428 lb (194 kg) of 1,3-propanediol and 550 lb (250 kg) of terephthalic acid were charged to the reactor. Esterification catalyst (monobutyl tin oxide at a level of 90 ppm Sn (tin)) was added to the reactor to speed the esterification when desired. The reactor slurry was agitated and heated at atmospheric pressure to 210° C. and maintained while reaction water was removed and the esterification was completed. At this time the temperature was increased to 235° C., a small amount of 1,3-propanediol was removed and the contents of the reactor were transferred to the clave.

With the transfer of reactor contents, the clave agitator was started and 91 grams of tetraisopropyl titanate was added as a polycondensation catalyst. If titanium dioxide was desired in the polymer, a 20% slurry in 1,3-propanediol was added to the clave in an amount to give 0.3 wt. % in polymer. The process temperature was increased to 255° C. and the pressure was reduced to 1 mm Hg (133 Pa). Excess glycol was removed as rapidly as the process would allow. Agitator speed and power consumption were used to track molecular weight build. When the desired melt viscosity and molecular weight were attained, clave pressure was raised to 150 psig (1034 kPa gauge) and clave contents were extruded to a cutter for pelletization.

$TiO_2$ was added in the same amount and in the same way as in Polymer Preparation 1.

Polymer of Example II-1

Batch poly(trimethylene terephthalate) polymer having the properties described in Table 1 and 0.3 weight % $TiO_2$ was used for Example II-1.

EXAMPLE II

Several samples of poly(trimethylene terephthalate) polymer, prepared as described in Example I, were spun into partially oriented filaments, using a conventional remelt single screw extrusion process and conventional polyester fiber melt-spinning (S-wrap) process, as illustrated in FIG. 1. The spinning conditions and properties for the resulting partially oriented yarns are set forth in Table I. The starting polymers had varying intrinsic viscosities, as indicated in Table I. The polymer was extruded through spinneret orifices having a diameter of about 0.23 mm. The spin block temperature was varied to obtain the polymer temperatures indicated in Table I. The filamentary streams leaving the spinneret were quenched with air at 21° C. and collected into bundles of filaments. Spin finish was applied in the amounts indicated in Table I, and the filaments were interlaced and collected as multi-filament yarn.

Each of the partially oriented yarns spun in this example was suitable as a very fine denier feed yarn for making drawn yarns according to the present invention, as illustrated in Example IV. Yarn item "II-10" was suitable as a very fine denier direct-use partially oriented yarn in some applications. Such a fine denier partially oriented poly(trimethylene terephthalate) yarn may be woven or knit into end use fabrics without further drawing.

TABLE I

| | Spinning Conditions | | | | | Winding | Spun Yarn Properties | | | | | | |
|---|---|---|---|---|---|---|---|---|---|---|---|---|---|
| Id. | IV | Speed, m/m | Temp, ° C. | Finish, % | # of Fils. | Speed, m/m | Yarn Denier (dtex) | Denier Per Filament (dtex) | Ten., g/d (dN/tex) | $E_B$, % | Mod, g/d (dN/tex) | DHS, % | BOS, % |
| II-1 | 1.04 | 1829 | 254 | 0.60 | 100 | 1808 | 107(119) | 1.07(1.19) | 2.47(2.18) | 128 | 18.6(16.4) | — | 52 |
| II-2 | 1.2 | 2743 | 275 | 0.50 | 100 | 2680 | 95(106) | 0.95(1.06) | 2.98(2.63) | 83 | 20.2(17.8) | — | 42 |
| II-3 | 0.88 | 2743 | 270 | 0.50 | 100 | 2706 | 96(107) | 0.96(1.07) | 2.7(2.38) | 98 | 20.1(17.7) | 41 | 43 |
| II-4 | 0.88 | 2746 | 270 | 0.50 | 200 | 2670 | 201(223) | 1.01(1.11) | 2.73(2.41) | 91 | 22.8(20.1) | 28 | 38 |
| II-5 | 0.88 | 3200 | 265 | 0.60 | 100 | 3100 | 112(124) | 1.12(1.24) | 2.85(2.52) | 82 | 17.0(15.0) | — | 36 |
| II-6 | 0.88 | 3200 | 265 | 0.60 | 100 | 3100 | 150(167) | 1.50(1.67) | 2.77(2.44) | 81 | 17.7(15.6) | — | 36 |
| II-7 | 0.88 | 3200 | 265 | 0.60 | 100 | 3155 | 113(126) | 1.13(1.26) | 2.78(2.45) | 83 | 18.8(16.6) | — | 40 |
| II-8 | 0.88 | 3200 | 265 | 1.00 | 100 | 3164 | 153(170) | 1.53(1.70) | 2.73(2.41) | 75 | 20.5(18.1) | — | 39 |
| II-9 | 0.88 | 4115 | 265 | 0.60 | 100 | 4042 | 88(98) | 0.88(0.98) | 3.29(2.90) | 60 | 21.7(19.2) | — | 31 |
| II-10 | 0.92 | 4115 | 265 | 0.50 | 100 | 4042 | 84(93) | 0.84(0.93) | 3.15(2.78) | 63 | 24.5(21.6) | — | 25 |

EXAMPLE III

This example showed the spinning parameters used to spin additional samples of poly(trimethylene terephthalate) polymer into partially oriented filaments. The polymers used in this example were prepared as described in Example I. The spinning conditions and properties for the resulting partially oriented feed yarns are set forth in Table II. As with the feed yarns from Example II, the partially oriented yarns spun in this example were suitable for making very fine denier drawn yarns. Yarn item "III-15" was also suitable as a very fine denier direct-use partially oriented yarn.

TABLE II

| | Spinning Conditions | | | | | Winding | Spun Yarn Properties | | | | | | |
|---|---|---|---|---|---|---|---|---|---|---|---|---|---|
| Id. | IV | Speed, m/m | Temp, ° C. | Finish, % | # of Fils. | Speed, m/m | Yarn Denier (dtex) | Denier Per Filament (dtex) | Ten., g/d (dN/tex) | $E_B$, % | Mod, g/d (dN/tex) | DHS, % | BOS, % |
| III-11 | 1.05 | 2743 | 270 | 0.40 | 100 | 2670 | 96(107) | 0.96(1.07) | 2.79(2.46) | 91 | 22.7(20.0) | 30 | 37 |
| III-12 | 1.05 | 2743 | 270 | 0.40 | 100 | 2670 | 95(106) | 0.95(1.06) | 2.07(2.71) | 81 | 23.4(20.7) | 25 | 29 |
| III-13 | 0.88 | 3658 | 265 | 1.00 | 100 | 3612 | 137(152) | 1.37(1.52) | 2.96(2.61) | 68 | 20.7(18.3) | — | 30 |
| III-14 | 0.88 | 4115 | 265 | 1.00 | 100 | 4078 | 123(137) | 1.23(1.37) | 2.87(2.53) | 62 | 20.1(17.7) | — | 17 |
| III-15 | 0.92 | 4115 | 265 | 0.50 | 100 | 4042 | 78(87) | 0.78(0.87) | 3.27(2.89) | 66 | 24.4(21.5) | — | 27 |

EXAMPLE IV

The partially oriented feed yarns from Example II were drawn at a speed of 400 meters per minute ("mpm") over a heater plate at varying temperatures, with varying draw ratios. The drawing parameters and drawn yarn properties are provided in Table III. As shown in Table III, the yarns of the present invention were drawn such that ΔDR is less than ten percent.

TABLE III

| | Drawing Conditions | | Drawn Yarn Properties | | | | | | | Predicted Draw Ratio | |
|---|---|---|---|---|---|---|---|---|---|---|---|
| Id. | Draw Ratio | Heater Plate ° C. | Yarn Denier (dtex) | Denier Per Filament (dtex) | Tenacity, g/d (dN/tex) | $E_B$, % | Modulus, g/d (dN/tex) | DHS, % | BOS, % | Draw Ratio | ΔDR, % |
| IV-1 | 1.40 | 130 | 78(87) | 0.78(0.87) | 2.98(2.63) | 54 | 21.2(18.7) | — | 13.3 | 1.44 | 2.86 |
| | 1.50 | | 73(81) | 0.73(0.82) | 3.21(2.83) | 43 | 23.4(20.7) | — | 13.9 | 1.54 | 2.67 |
| | 1.52 | | 73(81) | 0.73(0.81) | 3.21(2.83) | 39 | 23(20.3) | — | 14.0 | 1.58 | 3.95 |

TABLE III-continued

| | Drawing Conditions | | Drawn Yarn Properties | | | | | | | Predicted Draw Ratio | |
|---|---|---|---|---|---|---|---|---|---|---|---|
| Id. | Draw Ratio | Heater Plate ° C. | Yarn Denier (dtex) | Denier Per Filament (dtex) | Tenacity, g/d (dN/tex) | $E_B$, % | Modulus, g/d (dN/tex) | DHS, % | BOS, % | Draw Ratio | ΔDR, % |
| IV-2 | 1.1 | 160 | 88(98) | 0.88(0.98) | 3.13(2.76) | 57 | 24.5(21.6) | 10 | 7.0 | 1.15 | 4.55 |
| | 1.2 | | 82(91) | 0.82(0.91) | 3.59(3.17) | 50 | 23.7(20.9) | 13 | 10.0 | 1.20 | 0.00 |
| | 1.3 | | 82(91) | 0.81(0.90) | 3.83(3.38) | 38 | 30(26.5) | 16 | 11.0 | 1.29 | −0.77 |
| | 1.4 | | 75(83) | 0.75(0.83) | 4.06(3.58) | 29 | 28(24.7) | 16 | 13.0 | 1.38 | −1.43 |
| | 1.5 | | 67(74) | 0.67(0.74) | 4.52(3.99) | 27 | 29.3(25.9) | 16 | 13.0 | 1.39 | −7.33 |
| IV-3 | 1.1 | 120 | 88(98) | 0.88(0.98) | 2.69(2.37) | 70 | 22.4(19.8) | 11 | 8.0 | 1.15 | 4.55 |
| | 1.2 | | 81(90) | 0.81(0.90) | 2.71(2.39) | 51 | 23.4(20.7) | 15 | 12.0 | 1.28 | 6.67 |
| | 1.3 | | 76(84) | 0.76(0.84) | 3.12(2.75) | 45 | 25.6(22.6) | 17 | 14.0 | 1.33 | 2.31 |
| IV-4 | 1.1 | 120 | 186(207) | 0.93(1.03) | 2.54(2.24) | 60 | 23.1(20.4) | 13 | 10.0 | 1.18 | 7.27 |
| | 1.2 | | 173(192) | 0.86(0.96) | 2.84(2.51) | 51 | 25.4(22.4) | 16 | 14.0 | 1.24 | 3.33 |
| | 1.3 | | 161(179) | 0.81(0.90) | 2.73(2.41) | 36 | 26.5(23.4) | 18 | 15.0 | 1.36 | 4.62 |
| IV-5 | 1.3 | 160 | 85(94) | 0.85(0.94) | 3.52(3.11) | 36 | — | — | — | 1.30 | 0.00 |
| IV-6 | 1.35 | 160 | 82(91) | 0.82(0.91) | 3.69(3.26) | 30 | — | — | — | 1.35 | 0.00 |
| IV-7 | 1.3 | 160 | 91(101) | 0.91(1.01) | 3.38(2.98) | 34 | 25.4(22.4) | — | 10.6 | 1.33 | 2.31 |
| | 1.35 | | 87(97) | 0.87(0.97) | 3.77(3.33) | 36 | 25.7(22.7) | — | 11.4 | 1.31 | −2.96 |
| | 1.4 | | 84(93) | 0.84(0.93) | 3.83(3.38) | 30 | 26.3(23.2) | — | 11.3 | 1.37 | −2.14 |
| | 1.45 | | 81(90) | 0.81(0.90) | 3.97(3.5) | 28 | 25.8(22.8) | — | 11.6 | 1.38 | −4.83 |
| IV-8 | 1.5 | 160 | 109(121) | 1.09(1.21) | 4.04(3.57) | 25 | 24.1(21.3) | — | 12.0 | 1.36 | −9.33 |
| IV-9 | 1.2 | 160 | 71(79) | 0.71(0.79) | 4.09(3.61) | 36 | 28.4(25.1) | — | 10.0 | 1.16 | −3.33 |
| | 1.25 | | 72(80) | 0.72(0.80) | 3.95(3.49) | 30 | 27.7(24.4) | — | 10.8 | 1.21 | −3.20 |
| | 1.3 | | 75(83) | 0.75(0.83) | 3.85(3.4) | 26 | 24.3(21.4) | — | 10.6 | 1.24 | −4.62 |
| IV-10 | 1.1 | 160 | 74(82) | 0.74(0.82) | 3.22(2.84) | 40 | 24.6(21.7) | — | 8.0 | 1.15 | 4.55 |
| | 1.2 | | 70(78) | 0.70(0.78) | 3.48(3.07) | 30 | 25.9(22.9) | — | 11.0 | 1.23 | 2.50 |

What is claimed is:

1. A drawn yarn made by the following process:

(1) providing a polyester polymer having an intrinsic viscosity of at least 0.80 dl/g comprising at least 85 mole % poly(trimethylene terephthalate) wherein at least 85 mole % of repeating units consist of trimethylene units;

(2) spinning the polyester polymer by melt-extruding the polyester polymer at a temperature between about 255° C. and 275° C. to form a partially oriented feed yarn;

(3) preparing a drawn yarn from the partially oriented feed yarn, wherein said drawn yarn has the following characteristics:

(a) a denier per filament less than about 1.0; and (b) an actual draw ratio within 10 percent of a predicted draw ratio, wherein the predicted draw ratio is determined according to: [(elongation to break of the feed yarn)+115]/[(elongation to break of the drawn yarn)+115)].

2. The drawn yarn of claim 1, wherein the actual draw ratio is within 5 percent of the predicted draw ratio.

3. The drawn yarn of claim 1, wherein the actual draw ratio is within 3 percent of the predicted draw ratio.

4. The drawn yarn of claim 1, wherein the spinning temperature is between 260° C. and 270° C.

5. The drawn yarn of claim 1, wherein the spinning temperature is at least 265° C.

6. The drawn yarn of claim 1, wherein the polyester is melt-extruded on a spinneret having orifices between about 0.12 to 0.38 mm in diameter.

7. The drawn yarn of claim 1 wherein the polyester polymer has an intrinsic viscosity of at least 0.90 dl/g.

8. The drawn yarn of claim 1 wherein the polyester polymer has an intrinsic viscosity of at least 1.00 dl/g.

9. The drawn yarn of claim 1 wherein the fine denier partially oriented feed yarn has a denier per filament less than 2.

10. The drawn yarn of claim 1 wherein the fine denier partially oriented feed yarn has a denier per filament less than 1.5.

11. The drawn yarn of claim 1 wherein the fine denier partially oriented feed yarn has a denier per filament less than 1.0.

12. The drawn yarn of claim 9, wherein the actual draw ratio is within 5 percent of the predicted draw ratio.

13. The drawn yarn of claim 10, wherein the actual draw ratio is within 5 percent of the predicted draw ratio.

14. The drawn yarn of claim 9, wherein the actual draw ratio is within 3 percent of the predicted draw ratio.

15. A fine denier undrawn partially oriented feed yarn made by the process comprising providing a polyester polymer comprising at least 85 mole % poly(trimethylene terephthalate) wherein at least 85 mole % of repeating units consist of trimethylene units, and wherein said polymer has an intrinsic viscosity of at least 0.80 dl/g, and spinning the polyester polymer by melt-extruding the polyester polymer at a spinning temperature between about 255° C. and about 275° C. to form a fine denier undrawn partially oriented feed yarn, wherein the fine denier undrawn partially oriented feed yarn has a denier per filament less than 2.

16. The fine denier feed yarn of claim 15, wherein the denier per filament is less than 1.5.

17. The fine denier feed yarn of claim 15, wherein the denier per filament is less than 1.0.

18. The fine denier feed yarn of claim 15, wherein the polymer has an intrinsic viscosity of at least 0.90 dl/g.

19. The fine denier feed yarn of claim 15, wherein the polymer has an intrinsic viscosity of at least 1.00 dl/g.

20. A drawn yarn prepared from a polyester polymer having an intrinsic viscosity of at least 0.80 dl/g comprising at least 85 mole % poly(trimethylene terephthalate) wherein at least 85 mole % of repeating units consist of trimethylene units, wherein the drawn yarn has a denier per filament less than about 1.0.

* * * * *